United States Patent [19]

Kim et al.

[11] 4,359,411

[45] Nov. 16, 1982

[54] FLEXIBLE SEMICONDUCTIVE POLYMERS

[75] Inventors: Oh-Kil Kim, Burke, Va.; Robert B. Fox, Washington, D.C.

[73] Assignee: The United States of America as represented by the Secretary of the Navy, Washington, D.C.

[21] Appl. No.: 193,864

[22] Filed: Oct. 3, 1980

[51] Int. Cl.[3] ..... H01B 1/00

[52] U.S. Cl. ..... 252/500; 252/511; 252/518; 252/521; 357/8

[58] Field of Search ..... 252/500, 518, 511, 521; 357/8, 10; 260/37 R

[56] References Cited

U.S. PATENT DOCUMENTS

| | | | |
|---|---|---|---|
| 3,424,698 | 1/1969 | Lupinski et al. | 252/500 |
| 3,808,494 | 4/1974 | Hayashi et al. | 252/500 |
| 4,293,452 | 10/1981 | Fox et al. | 252/518 |

*Primary Examiner*—Joseph L. Schofer
*Assistant Examiner*—J. L. Barr
*Attorney, Agent, or Firm*—Robert F. Beers; William T. Ellis; Daniel R. Zirker

[57] ABSTRACT

An electrically conductive polymeric composition is fabricated by dispersing polymeric ether complexes of TCNQ salts within a flexible, thermoplastic polymer matrix. The compositions form flexible, homogeneous, films which exhibit substantially superior properties over currently available TCNQ salt based systems.

6 Claims, No Drawings

FLEXIBLE SEMICONDUCTIVE POLYMERS

BACKGROUND OF THE INVENTION

This invention is concerned with polymeric conductors, and more particularly, with flexible, film-forming, organic polymeric conductors.

A great amount of research has been undertaken in an attempt to develop an organic material or class of materials which is a good conductor of electricity, yet which also is flexible, easily processable and has superior mechanical properties. Such a material would be extremely useful, for example, in fabricating semiconductors, electronic devices, and electromagnetic sensors.

There are a large number of resinous compositions which are electroconductive, usually existing as a mixture of organic resin matrix having a number of conductive particles (metals, graphite) dispersed within. These mixtures however, suffer from poor mechanical properties, primarily due to the lack of chemical bonding between the various elements.

One particular organic compound whose salts and complexed display superior conductive properties is the organic acceptor, tetracyanoquinodimethane (TCNQ):

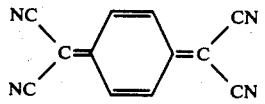

It is known that TCNQ is a strong $\pi$-acid which forms stable, crystalline anion-radical salts of the type $M^{n+}(TCNQ^{\overline{\cdot}})_n$ as well as complex salts of the formula $M^{n+}(TCNQ^{\overline{\cdot}})_n(TCNQ^{\circ})$, which also contain formally neutral TCNQ. These metal salts are semiconductors, existing in a rigid crystalline lattice structure.

Most semiconductors, including these TCNQ based salts, are non-flexible, opaque solids which fracture easily. Although flexible, film-forming polymeric semiconductors have been experimented with, several problems have proven difficult to solve. For example, the insulating gap between conductor particles has created a resistance that can result in thermal breakdown, and environmental damage has also proven to be a severe problem.

A recent attempt to develop materials that overcome such defects is disclosed in Ser. No. 117,162, filed 1/31/80, wherein crown ether complexes of TCNQ salts have been incorporated into various polymeric matrices to form flexible thermoplastic films. However, these compositions suffer from a resulting phase separation with the crown ethers, leading to a non-homogenous crystalline structure, with a resultant loss of efficiency. Furthermore, these compositions are also moisture sensitive under certain conditions.

OBJECTS OF THE INVENTION

It is an object of the present invention to produce thermoplastic, film-forming organic semiconductor systems.

It is another object of the present invention to fabricate a class of materials which has excellent semiconductor characteristics as well as exhibiting the physical characteristics seen in thermoplastic polymers.

It is a still further object of this invention to provide flexible, moldable and easily processable semiconductors.

SUMMARY OF THE INVENTION

These and other objects are achieved by the fabrication of a flexible, film-forming electrically conductive polymeric composition consisting essentially of a thermoplastic polymer matrix having dispersed therein a complex represented by the formula: $[E(M^{n+})](TCNQ^{\overline{\cdot}})_n\ TCNQ^{\circ}{}_m$ wherein m and n are integers and m may be zero, TCNQ is 7,7,8,8-tetracyanoquinodimethane, M is an alkali metal, alkaline earth metal, or $NH_4^+$, and E is a polymeric aliphatic or aromatic ether molecule.

DETAILED DESCRIPTION OF THE INVENTION

The TCNQ salts which are electrically conductive and suitable for use in the invention are the alkali metal, alkaline earth metal, and ammonium salts, as well as mixtures of these salts. The cations include lithium, sodium, potassium, rubidium, cesium, calcium, strontium, barium and ammonium, with potassium and ammonium being most preferred. The salts can be prepared by any of the usual methods, e.g., L. R. Melby et al. in J. Am. Chem. Soc. 84, 3374 (1962). The salt concentration can range anywhere from 5–50 wt. % depending upon the precise conductivity desired.

The polymeric ethers useful in this invention are aliphatic and aromatic ethers such as poly (ethylene oxide) (PEO), polyoxetane, polytetrahydrofuran, poly (vinyl ethers), polyphenylene oxide, polydioxolan, and the like, as well as mixtures of the above. PEO is the preferred one, and polyethers of high molecular weight are generally more desirable, although molecular weight is not a critical parameter.

The polymeric ethers used in this invention are believed to function as a complexing agent for the TCNQ salts. TCNQ salts are normally insoluble in most common organic solvents, e.g., benzene, dichloroethane, tetrahydrofuran and the like, instead forming a heterogeneous material which is interspersed with suspended purple solids after evaporation of the solvent. Surprisingly, in the presence of a polymeric ether, particularly PEO, the TCNQ salt mixtures are rendered soluble and form a flexible, homogeneous mixture. It is hypothesized that the salts are solubilized by forming a complex with the cations of $M^+TCNQ^{\overline{\cdot}}$ e.g., .

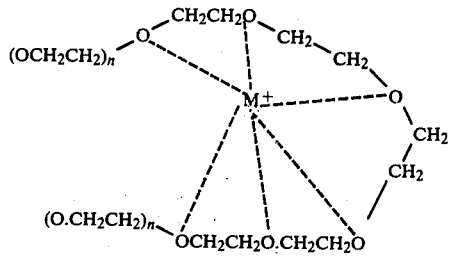

thus solubilizing to produce a completely homogeneous film. The TCNQ salts are believed to align along the polymer chain throughout the complex formation. The concentration of polymeric ether permitted in the conducting system can range up to about 50 wt. percent.

The matrix polymer of the invention can comprise any thermoplastic polymer, e.g., polymethyl methacrylate, polyacrylonitrile, polycarbonate, polystyrene, polyvinylacetal, as well as various mixtures of the above. The concentration of the matrix polymer can vary over a wide range of proportions, about 0–90 wt. percent, and is believed to improve the mechanical properties, the processability, as well as the moisture resistance of the polymeric ether-complexed TCNQ salts.

The polymeric ethers form two types of ether salt complexes, represented by the generic formula $[E(M^{n+})](TCNQ^{\dot{-}})_n TCNQ^{\circ}{}_m$ wherein E represents one of the above mentioned polymeric ethers, M is defined as before, n is 1 or 2, and m is 0 or 1.

The TCNQ polymeric ether simple salt is devoid of neutral TCNQ° e.g., m=o, thus reducing the formula to $[E(M^{n+})](TCNQ^{\dot{-}})_n$. This salt can be made by mixing a $M^{+TCNQ^{\dot{-}}}$ salt with a desired polymeric ether or mixture of polymeric ethers in a solvent at a temperature of from 0° C. to 50° C. Suitable solvents are ethanol, methylene chloride, and acetonitrile. It is preferred that an excess of poly ether be used. The reaction proceeds quickly to completion, and the product is recovered after evaporation of the solvent.

The use of TCNQ° (neutral TCNQ) in the system, as has been discussed supra, has been found not only to increase the conductivity of the resulting system but also the stability.

The following examples are given by way of explanation and are not meant to limit this disclosure or the claims that follow.

EXAMPLE I

To solution of 150 mg PEO in 30 ml dichloroethane was added 50 mg (0.20 mmol) $K^{+(TCNQ)^{\dot{-}}}$ with stirring at least several hours at room temperature. To the resulting homogeneous solution was then added 40 mg (0.20 mmol) TCNQ and 470 mg poly (methyl methacrylate). Stirring was further continued until a clear solution of a green color was obtained. A conductive film was made by casting the solution on a quartz or an aluminum plate by evaporating the solvent under atmospheric pressure at room temperature, and the thus-obtained air-dried film was further dried in vacuo 3 hrs. at 40° C. The conductivity of a dark green, transparent and flexible film was determined to be $10^{-8}\ \Omega^{-1}\ cm^{-1}$.

EXAMPLE II

To a solution of 150 mg. polyethylene oxide in 30 ml dichloroethane was added 74 mg (0.30 mmol) $NH_4^+(TCNQ)^{\dot{-}}$, followed by the addition of 68 mg (0.30 mmol) TCNQ and 470 mg poly (methyl methacrylate). The conditions of dissolving the components, casting the film and the conductivity measurement are as same as in Example I. The conductivity of a dark green, transparent and flexible film was determined to be $10^{-7}\Omega^{-1}\ cm^{-1}$.

EXAMPLE III

To a solution of 470 mg poly (vinyl butyral) in 25 ml N, N-dimethyformamide (DMF) was added 150 mg PEO with stirring at least several hours to a complete homogeniety and followed by the addition of 50 mg (0.20 mmol) $K^+(TCNQ)^{\dot{-}}$ and 40 mg (0.20 mmol) TCNQ° with stirring to obtain a clear dark green solution. A film was obtained by casting the solution on an aluminum plate and by evaporating the solvent at a moderatly reduced pressure (10–15 mm Hg) at 30° C. The conductivity of the resulting dark-green flexible film was determined to be $2\times10^{-6}\Omega^{-1}\ cm^{-1}$.

Examples 1 and 2 disclose the use of a solvent in which the $TCNQ^{\dot{-}}$ salts are not soluble until the addition of a polyether such as PEO, whereas Example 3 discloses a solvent (DMF) in which $TCNQ^{\dot{-}}$ salts are soluble without the addition of a polyether.

The conductivities of the TCNQ polyether salts disclosed in Examples 1 and 2 are of the magnitude of $10^5$ times greater than the same system minus the addition of the polymeric ether. In Example 3 the addition of PEO enhanced the conductivity $10^2$ times greater than the same system without the addition of the polymeric ether.

The conductivity measurements were undertaken by measuring the conductivity of thin films ($3\sim5\times10^{-3}$ cm) cast on a glass or aluminum plate and evaporating the solvent. Several different techniques were used, all agreeing with each other within an order of magnitude:

A. A film was cast on a quartz plate with 1.3 cm electrodes having a grid comprised of 10 alternating gold and chromium wires spaced 0.1 cm apart. The dc current induced was measured in response to various voltages up to 300 V.

B. Gold was vapor-deposited on both sides of a film to make a sandwich type cell. Under application of the usual voltages the dc current was measured as before.

C. The conventional four-point technique was used with a free film or a film on a substrate.

The invention combines the advantages of the electrical properties, particularly semiconductivity, of crystalline salts, with the improved processability and flexibility of thermoplastic polymers and polymeric ethers which are easily made into transparent flexible films, sheets, rods, and other desired shapes. Such semiconductors are also economical, being made from cheap, readily abundant materials, and can be expected to find utility wherever semiconductors are used.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the U.S. is:

1. A flexible, film-forming, electrically conductive polymeric composition consisting of a thermoplastic polymer matrix having dispersed therein an effective amount of a complex represented by the formula:

$$[E\cdot(M^{n+})][TCNQ^{\dot{-}}]_n TCNQ^{\circ}{}_m$$

wherein n is 1 or 2, m is o or 1, TCNQ is 7,7,8,8 tetracyanoquinodimethane, M is an alkali metal, alkaline earth metal, or ammonium, and E is a polymeric ether selected from the class consisting of poly(ethylene oxide), polyoxethane, polytetrahydrofuran, poly(vinyl ethers), polyphenylene oxide, polydioxalan, and mixtures thereof.

2. The composition of claim 1 wherein the thermoplastic polymer matrix is selected from the group consisting of polymethylmethacrylate, polyacrylonitrile, polycarbonate, polystyrene, polyvinylacetal and mixtures thereof.

3. A composition as claimed in claim 2 wherein M is selected from the group consisting of lithium, sodium, potassium, rubidium, cesium, calcium, strontium, barium, and ammonium.

4. The composition of claim 2 wherein said polymeric ether is poly (ethylene oxide).

5. The composition of claim 3 wherein said complex is present in said matrix in an amount of at least 10 weight percent of total composition weight.

6. The composition of claim 5 wherein M is potassium or ammonium.

* * * * *